US007735448B2

(12) United States Patent
Rahimi

(10) Patent No.: US 7,735,448 B2
(45) Date of Patent: Jun. 15, 2010

(54) BONDING GARMENTS WITH ELASTOMERS AND METHOD OF PRODUCTION

(75) Inventor: Shmuel Rahimi, Nazareth Ilit (IL)

(73) Assignee: Rahimi Textile Technologies Ltd., Shimshit (IL)

( * ) Notice: Subject to any disclaimer, the term of this patent is extended or adjusted under 35 U.S.C. 154(b) by 0 days.

(21) Appl. No.: 11/968,198

(22) Filed: Jan. 2, 2008

(65) Prior Publication Data

US 2008/0177415 A1 Jul. 24, 2008

Related U.S. Application Data

(60) Provisional application No. 60/885,895, filed on Jan. 21, 2007.

(51) Int. Cl.

| | |
|---|---|
| ***B05B 13/02*** | (2006.01) |
| ***B05B 7/06*** | (2006.01) |
| ***B05C 5/00*** | (2006.01) |
| ***B05C 11/00*** | (2006.01) |

(52) U.S. Cl. ..... 118/325; 118/313; 118/665; 118/686; 118/679; 156/524; 156/529; 156/463; 156/468; 156/578

(58) Field of Classification Search ..... 118/300, 118/313, 325, 683, 679, 37, 314, 315, 686, 118/665, 35; 347/5, 9, 15; 156/578, 529, 156/199, 205, 459, 469, 474, 88, 524, 525, 156/250, 251, 93, 202, 204, 461, 463, 468; 427/284, 285, 288

See application file for complete search history.

(56) References Cited

U.S. PATENT DOCUMENTS

| | | | | |
|---|---|---|---|---|
| 2,740,457 | A | 4/1956 | Wood et al. | |
| 2,744,844 | A | 5/1956 | Wood et al. | |
| 5,203,268 | A | 4/1993 | Schips | |
| 5,964,973 | A * | 10/1999 | Heath et al. | 156/161 |
| 6,562,168 | B1 * | 5/2003 | Schmitt et al. | 156/88 |
| 6,579,403 | B2 * | 6/2003 | Tolbert et al. | 156/291 |
| 6,641,695 | B2 * | 11/2003 | Baker | 156/265 |
| 6,681,407 | B2 | 1/2004 | Martz | |
| 6,827,806 | B2 | 12/2004 | Uitenbroek et al. | |
| 6,887,941 | B2 * | 5/2005 | Zhou | 525/191 |
| 2003/0205330 | A1 | 11/2003 | Foucht et al. | |
| 2004/0068246 | A1 * | 4/2004 | Rose et al. | 604/385.27 |
| 2005/0233137 | A1 * | 10/2005 | Angelino et al. | 428/339 |
| 2005/0255249 | A1 | 11/2005 | Schlatterbeck et al. | |
| 2006/0083900 | A1 * | 4/2006 | Ashraf | 428/182 |

* cited by examiner

*Primary Examiner*—Yewebdar T Tadesse
(74) *Attorney, Agent, or Firm*—Mark M. Friedman

(57) ABSTRACT

The present invention relates to a system and method of bonding garments with elastomers and particularly to a system and method to cut and hem in a garment in a continuous process and also a system and method to incorporate an elastic strip into a garment in a continuous process and a system and method to provide computer control of hemming, bonding, gathering and inserting an elastic strip into a garment.

19 Claims, 6 Drawing Sheets

BONDING GARMENTS WITH ELASTOMERS AND METHOD OF PRODUCTION

RELATED APPLICATIONS

This patent application claims the benefit of U.S. Provisional Patent Application No. 60/885,895, filed Jan. 21, 2007

FIELD AND BACKGROUND OF THE INVENTION

The present invention generally relates to the textile industry. More specifically, the present invention relates to the bonding of garments with elastomer and a method of production.

Since old ages, sewing garments was done with needles and threads. Conventionally, to hem a piece of cloth, a garment worker folds up a cut edge, folds it up again, and then sews it down. The process of hemming thus completely encloses the cut edge in cloth, so that it cannot ravel. Hems are used in order to tidy the edge of the fabric, where it was cut. The hem prevents the cut edge to become further separated, and provides a strong, neat and straight edge. The hem may be sewn down with a line of invisible hem-stitch or blind-stitch or sewn down by a sewing machine, usually leaving a visible line of sewing. Machines can also sew a reasonable facsimile of a hem-stitch, though the stitches will usually be larger and more visible. Most haute couture hems are sewn by hand for this reason.

Attention is now directed to FIG. 1*a*, which illustrate the production of a typical panty leg hole. The panty starts as a cylindrical piece of cloth 101. Cutting on lines 102*a-b* and sewing together the front and back at seam 104 (see FIG. 1*b*) produces Leg holes 103*a-b*. Then an elastic band is set around leg holes 103*a-b* and a hem is folded over the elastic band and sewn down. For easy dressing it is preferable that leg holes 103*a-b* can stretch to at least 180% of their unstressed circumference. For comfortable wearing it is desirable that back seams 105*a-b* of leg holes 103*a-b* can stretch without noticeable force to at least 125% of their unstressed length and that top front seams 106*a-b* of leg holes 103*a-b* can stretch without noticeable force to at least 110% of their unstressed length. Bottom front seams 107*a-b* of leg holes 103*a-b* do not need to stretch appreciably during wearing. In order to enable stretching of leg holes 103*a-b* it is necessary to gather material around the elastic band along the seam because the fabric of panties is not as elastic as the rubber band. For comfortable wearing and minimal seam thickness, the accumulation of material on back seams 105*a-b* should be more than the accumulation on top front seams 106*a-b*, which should be more than the accumulation on bottom front seam 107*a-b*. Another important demand is that after such stretching the seam will return to its original length almost immediately (short recovery time).

Often, as described in connection to FIG. 1*b*, especially in underwear, to make better closures, an elastic band is sewn on the hem. For example, synthetic panties generally have a cotton lined crotch and elastic band that form a full leg closure. Typically in the prior art (for example U.S. Pat. No. 5,203,268 to Schips), the elastic garment products are made with a single piece of elastic or two pieces, which are undulated. The stiff elastic stretched to a desired length serves as a form to ensure that the hem is straight and that (when the elastic returns to its un-stressed length) the material will have enough gathers to allow stretching of the seam.

Unfortunately, the elastic band increases the garment thickness in the hem region. The thick area can be seen and felt through the outer garment, resulting in reduced the wearing comfort and undesirable panty lines. Another problem is durability the rubber band. After a few washing cycles conventional rubber bands wear off or deteriorate and do not return to their original length.

Furthermore, conventionally sewing of an elastic band into a hem requires a multi-step process (starting of a subsequent step only after completing the previous step).

These are the three steps of the current conventional sewing process:

1. Cutting the entire length of the material.
2. Inserting the elastic band while stretching the elastic band to the desired length and fixing it to the garment (usually by local stitching).
3. Folding the material around the elastic band and sewing down the fold.

This three-step process of inserting an elastic band demands time and labor in the manufacturing process, and increases the cost of producing the garment.

The textile industry is looking for a solution to speed production of hems and particularly of elastic hems and to reduce the thickness of hems in underwear, especially in lingerie. In the industry's jargon, the solution is called "seamless"; sometimes it is also referred to as "stitchless" technology. Several attempts have been made to provide the production of underwear without the visible panty lines; however none have adequately provided a solution. For example, U.S. Pat. No. 6,681,407 to Christine Martz discloses a women's waistless and seamless clothing adherable underwear that includes an oval pad made of a soft absorbent material. The pad has strips of adhesive tape to attach to the inside crotch area of low slung clothing pants or tight pants. The problem with Martz is that the adhesive can pull away from the clothing if not secured properly. Moreover, due to the cost of the elastic band, this kind of solution is not always desirable.

Over the years, numerous techniques have been developed to taking advantage of the properties of elastomeric materials for bonding textiles.

Most elastomers are monomers that are applied in an uncured state. After curing (e.g. polymerization) the elastomer becomes an elastomeric rubbery type of solid at room temperature. While uncured, the elastomer (referred to hereafter as adhesive) is applied to the region to be bonded. The elastomer penetrates into the fabrics and cures. The elastomer may be used to bond the fabrics together, and still allow flexibility and elasticity. Under certain conditions, the cured elastomer may serve as a replacement for an elastic strip or rubber band. Thus, by incorporating an elastomer into a garment, a "built-in" elastic strip is produced. The hem of a "built in elastic strip" is much thinner than a hem including a pre-formed elastic strip sewn into the clothes. Hence a garment incorporating a thin elastomer closure may be described as "seamless". Furthermore, use of pre-formed elastic strips incurs extra manufacturing costs associated with the cost of the pre-formed band and the time and the work needed to sew the pre-formed band into the garment.

Conventionally, to create an elastic hem with an elastomer, a prefabricated elastomer band is inserted into the hem. The garment is then ironed to heat the band, melting the elastomer. Pressing the two fabrics together with the elastomer in-between, establishes the bond. Such prefabricated bands of elastomer are available from BEMIS Associates, Inc. (One Bemis Way, Shirley, Mass. 01464, USA) and are usually made of polyurethane. Unfortunately, this method has many disadvantages: first of all, the prefabricated bands are expensive; secondly, during the process the heat has to reach the band through the surrounding fabrics, the process is therefore very slow compared to sewing. To overcome this shortcoming, the power of the heat source may be increased, but increasing the power of the heat source entails a risk of burning the garment. Another disadvantage of this method is that polyurethanes have a long recovery time. The term "recovery time" refers hereinafter to the time needed for the elastomer to reach its initial length after been stretched. Polyurethanes take about a minute or more to recover.

Yet another common way to bond hems, typically in outer garments like dresses and trousers, is to spread fine particles of material, usually known as hot melt adhesive, inside the hem. The hem is then ironed, melting the particles, which become "bonding points" holding the hem. This method is not adequate for undergarments, where hems are very narrow, about 5 mm. It is also not used as a replacement for elastic strip, since the particles are not continuous. Therefore no continuous elastic band and no elasticity are formed. Only the region of the particle is bonded.

Despite all of the efforts that have been made to provide a facile, economical process for mass production of conformable garments, problems have, prior to the advent of the present invention, continued to plague the industry. In addition to many of the problems described above, many of the thermoplastic elastomeric materials that have been suggested present similar, as well as somewhat different problems. For example, since the elastic material is here contemplated for usage in garments, it is important that the material be characterized by its strength; not only strength in usage, but also in the high speed manufacturing processes employed. It is also important that the heated material possess sufficient strength as to resist breakage, particularly when the heated material is being worked on in a high-speed continuous production process. There is thus an unfulfilled need for selecting suitable elastomers overcoming the shortcomings described above.

Moreover, there is an unfulfilled need for providing a cost effective method to integrate an elastic strip into a garment.

SUMMARY OF THE INVENTION

The present invention is a method and system for improved garment production and particularly a system and method for bonding garments and producing stretchable portions of the garment. Particularly, the present invention supplies a method and system for bonding garments or hemming a garment or integrating an elastomeric strip into a garment and for on-line control of production of the garment. The garment may be a piece of clothing, or it may be a hat or a cover for an object (for example a protective pouch for a mobile phone or a piece of doll clothing or any other cloth object requiring a hem or elastic).

According to the teachings of the present invention there is provided a system for integrating an adhesive into a garment the system includes a liquid adhesive and an injecting head for depositing the liquid adhesive onto a location on the garment.

According to further features in preferred embodiments of the invention described below, the liquid adhesive includes a heat cured elastomer, a silicon based elastomer, a hot melt elastomer, a UV cured elastomer, a catalyst cured elastomer, or an RTV elastomer.

According to still further features in the described preferred embodiments, the system further includes a computer connected to the injecting head to control a rate of depositing.

According to still further features in the described preferred embodiments, the system further includes a second injecting head for depositing a second fluid onto the garment.

According to still further features in the described preferred embodiments, the system further includes a double injecting head with a mixer stick for depositing a mixed fluid onto the garment.

According to still further features in the described preferred embodiments, the second fluid is applied as a bead that is narrower than the bead of the first adhesive.

According to still further features in the described preferred embodiments, the second fluid includes a UV cured elastomer, a catalyst for speeding curing of the first adhesive a combination of an elastomer and a catalyst, an adhesive having more rapid curing than the first adhesive or an RTV elastomer.

According to still further features in the described preferred embodiments, the system further includes a cutting apparatus for cutting the garment and wherein the liquid adhesive serves to bond a hem of the edge resulting from cutting the garment.

According to still further features in the described preferred embodiments, the cutting apparatus and the injecting head are located in-line such that cutting of the garment and depositing of the liquid adhesive onto the garment occur simultaneously.

According to still further features in the described preferred embodiments, the system further includes a first tractor to feed the garment past the injection head, and a second tractor for straightening the garment.

According to still further features in the described preferred embodiments, the liquid adhesive cures to form an elastic strip.

According to still further features in the described preferred embodiments, the system further includes a first tractor to feed the garment past the injection head, and a second tractor for forming a gather in the garment.

According to the teachings of the present invention there is also provided a method for integrating an adhesive into a garment comprising the steps of depositing a liquid adhesive onto a location on the garment and curing the liquid adhesive.

According to further features in preferred embodiments of the invention described below, the method further comprises the step of depositing a fluid for instant strength bonding of the garment. The fluid may be a catalyst applied onto the liquid adhesive or the fluid may be a fast curing adhesive applied to a different location than the first adhesive.

According to further features in preferred embodiments of the invention described below, the method further comprises the step of addition of a fluid into the resin for instant strength bonding of the garment. The fluid may be a catalyst applied into the liquid adhesive or the fluid may be a fast curing adhesive applied to a different location than the first adhesive.

According to still further features in the described preferred embodiments, the fluid includes at least one of the following:

1. Fast curing elastomer, a catalyst for said liquid adhesive.
2. UV curing elastomer.
3. RTV elastomer.

According to the teachings of the present invention there is also provided a system for on-line control of advance of a fabric during production of a garments. The system comprises: a first tractor configured for advancing the garment at a first rate and a second tractor, said second tractor configured for advancing the garment at a second rate.

According to further features in preferred embodiments of the invention described below, the second tractor is configured for producing a gather in the garment and the second rate is slower than the first rate.

According to still further features in the described preferred embodiments, the second tractor is for producing a parallel seam and the second rate is equal to the first rate.

According to still farther features in the described preferred embodiments, the system further comprises a cutting device for cutting the garment. The seam to be bonded is a hem along an edge of a cut made by the cutting device.

According to still further features in the described preferred embodiments, the cutting device, the first tractor and the second tractor all act simultaneously on a single seam.

According to still further features in the described preferred embodiments, the second rate is adjustable independently of said first rate.

According to still further features in the described preferred embodiments, the system further comprises a computer for controlling the second rate.

TERMINOLOGY

The following terms are used in this application in accordance with their plain meanings, which are understood to be known to those of skill in the pertinent art(s). However, for the sake of further clarification in view of the subject matter of this application, the following explanations, elaborations and exemplifications are given as to how these terms may be used or applied herein It is to be understood that the below explanations, elaborations and exemplifications are to be taken as exemplary or representative and are not to be taken as exclusive or limiting. Rather, the terms discussed below are to be construed as broadly as possible, consistent with their ordinary meanings and the below discussion.

liquid—a substance that does not retain shape under application of a moderate force and does not independently return to a previous configuration (liquids include viscous pastes, resins or gums or a runny fluids).

fluid—a liquid, and

Elastic strip—a continuous length of stretchable material that recovers (returns to substantially its original length) after stretching, an elastic strip whose ends are joined to form a loop is also called an elastic band or an elastomeric band.

BRIEF DESCRIPTION OF THE DRAWINGS

Various embodiments of a system and method for a multi-protocol data storage device for preloading of a datum by a manufacturer are herein described, by way of example only, with reference to the accompanying drawings, where.

DESCRIPTION OF THE PREFERRED EMBODIMENTS

The principles and operation of a system and method for bonding garments with elastomers according to the present invention may be better understood with reference to the drawings and the accompanying description. It will be understood by those of ordinary skill in the art that the invention may be practiced without these specific details. In other instances, well-known devices, methods, procedures, and/or components have not been described in detail so as not to obscure the invention. It is also understood that the invention is not limited to bonding clothing, but may be used to bond cloth used for many purposes or even for bonding other materials.

The present invention is a system and method for bonding garments with elastomers and more precisely a system and method to incorporate an elastomeric strip into a garment in a single step and a system and method to hem a garment in a single step.

An important object of the invention is the provision of improved methods and apparatus of the foregoing character wherein a suitable elastomeric material has a substantially instant strength. During manufacturing, while a garment is moved from one working station to another the fabrics may split apart. The term "instant strength" refers hereinafter to the property of holding fabrics immediately after application so that the garment will not split apart during manufacturing. Generally an elastomer that holds in less than 3 seconds may be considered as providing "instant strength" since generally there are 3 seconds between processes on a textile assembly line and therefore an adhesive that holds in 3 seconds will not slow up the production process. If within the assembly line waiting time (generally around 3 seconds) the adhesive reaches a sticky/tacky state strong enough to hold the seam together during manufacturing, then the bonding can be considered instant strength, even if full curing takes longer than 3 seconds (commonly 10-18 sec). This instant strength can be achieved either by curing the adhesive fast enough, or by using a reactive hot melt adhesive, cooled down to its freezing state right after application. Fast curing can be achieved by UV curing or addition of a chemical catalyst. However, UV adhesives and high speed curing adhesives and catalysts are quite expensive. Thus an object of the present invention to provide a method for producing a cost effective bond.

Figure 2:
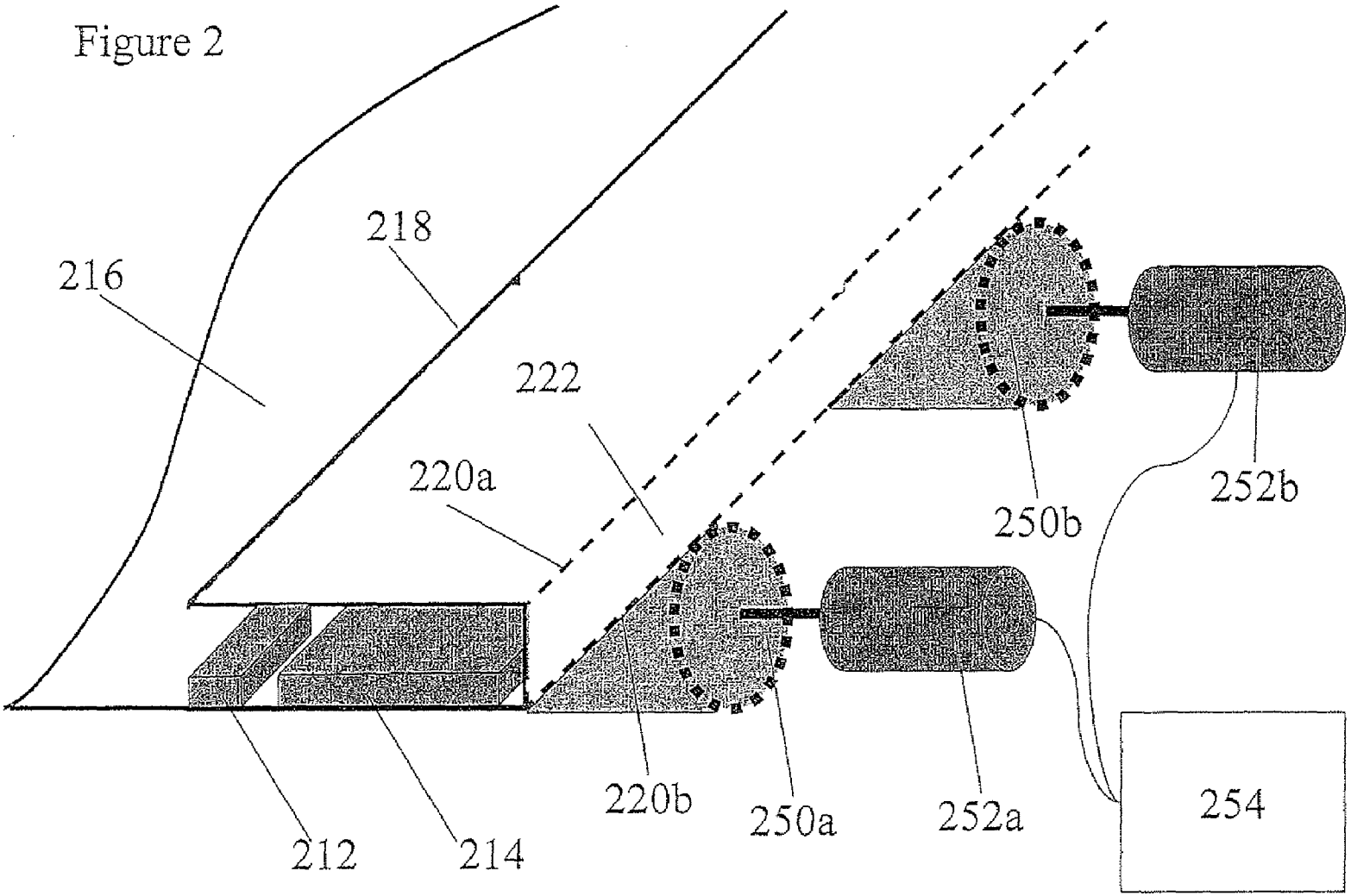
FIG. 2 illustrates the combination of a narrow bead of expensive fast UV cured liquid adhesive and a wide bead of non-expensive slow curing liquid adhesive to bond a seam while two adjustable rate tractors advance the fabric and produce gathers.

Reference is made now to FIG. 2 illustrating the combination of a narrow bead 212 of expensive fast UV cured liquid adhesive (alternatively narrow bead 212 may be an adhesive mixed with a fast acting catalyst) and a wide bead 214 of non-expensive slow curing liquid adhesive (in one preferred embodiment the adhesive of wide bead 214 takes three minutes to cure). Commonly, for panties, the width of wide bead 214 is 4 mm and the width of narrow bead 212 is less than 1 mm. The thickness of both beads is 0.2-0.4 mm. The method comprises the steps of cutting a fabric 216 to create an edge 218, folding fabric 216 along lines 220*a-b* to create a hem 222, applying wide bead 214 of a low cost adhesive inside hem 222; and applying narrow bead 212 of fast UV cured adhesive onto edge 218 of cut fabric 216; and illuminating the bonding area of edge 218 with a UV source to causes narrow bead 212 to cure. Thereby, the fast curing adhesive provides instant strength, until the slow curing adhesive cures. The rate of curing can be controlled by adjusting the humidity and the temperature of the curing adhesive.

Alternatively, instant strength could be accomplished using an adhesive with a chemical catalyst. In one alternative embodiment, hem 222 would be exactly as in FIG. 2 except that narrow bead 212 would be a chemically catalyzed fast curing elastomer.

Figure 3:
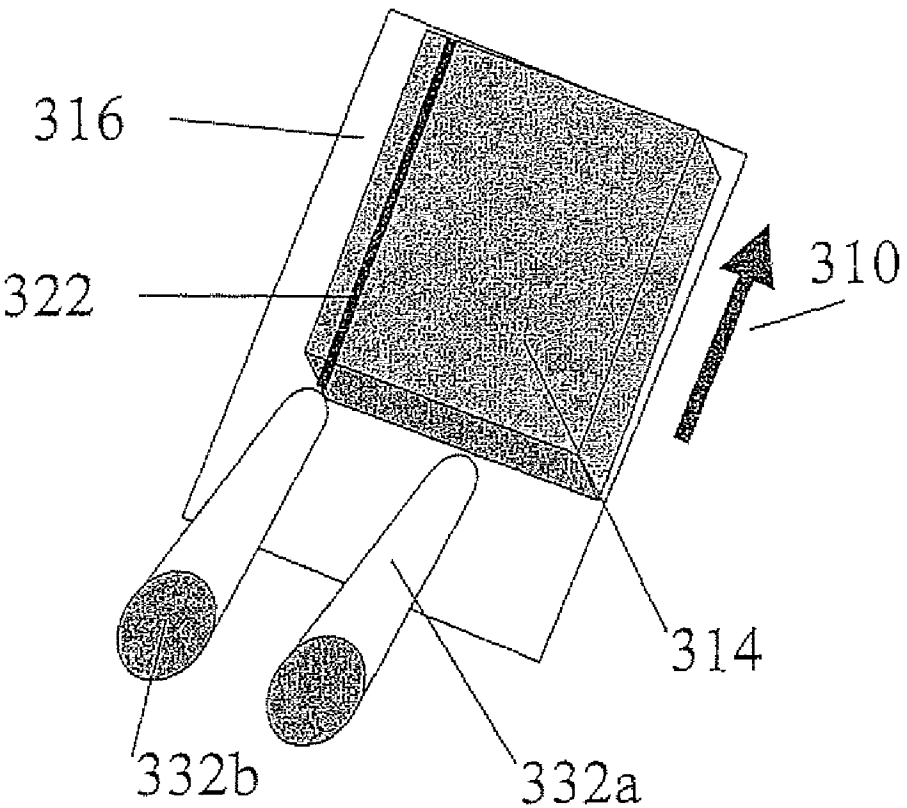
FIG. 3 illustrates the integration of a narrow bead of catalyst into a wide bead of liquid adhesive to bond a seam.

Alternatively in FIG. 3, as a fabric is advanced in the direction of arrow 310, an injection head 332*a* deposits a wide bead 314 of elastomer onto a fabric 316 while a second injection head 332*b* deposits a narrow layer 322 of catalyst onto wide bead 314. Layer 322 of catalyst is applied along the line where the edge of the hem is to be glued down. Thus the edge of wide bead 314 cures fast and provides instant strength.

Figure 4B:
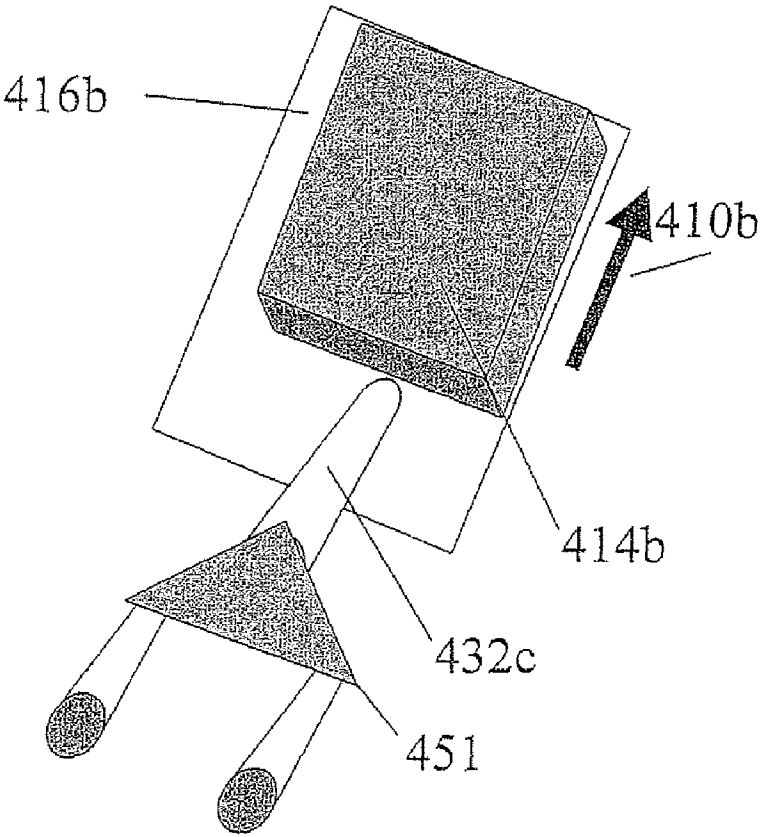
FIG. 4*b* illustrates the mixing of catalyst into a liquid adhesive to bond a seam.
Figure 4A:
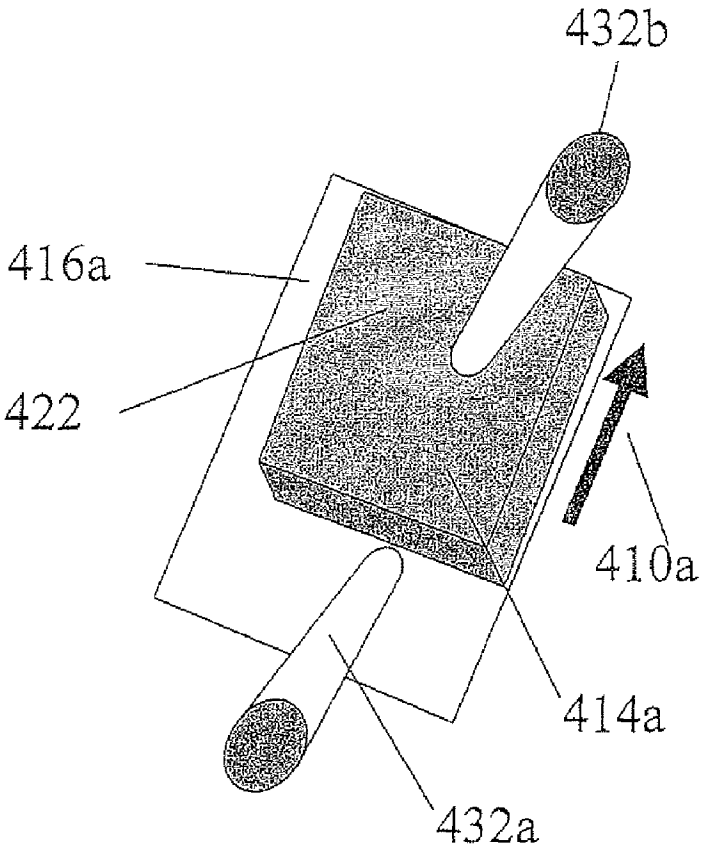
FIG. 4*a* illustrates the integration of a thin layer of catalyst onto a wide bead of liquid adhesive to bond a seam.

Alternatively, as illustrated in FIG. 4*a*, as a fabric is advanced in the direction of arrow 410*a*, an injection head 432*a* deposits a wide bead 414*a* of elastomer onto a fabric 416*a*, while a second injection head 432*b* sprays a thin layer 422 of catalyst onto wide bead 414*a*. Thus the wide bead 414*a* cures fast and provides instant strength.

Alternatively, as illustrated in FIG. 4*b*, as a fabric is advanced in the direction of arrow 410*b*, adhesive is mixed with catalyst in a mixer 451 before depositing on fabric 416*b*. Thus, there would only be one injection head 432*a* and the entire wide bead 414*b* would cure quickly.

In another embodiment of the present invention a cost effective bonding is formed from at least one material having a substantially instant strength, using a reactive hot melt silicone adhesive. Thus, there would only be one injection head 432*a* and the entire wide bead 414 would consist of quick curing reactive hot melt adhesive. For example, the reactive hot melt silicone adhesive may include of the following commercially available products: Dow Corning® InstantGlaze, Dow Corning® InstantGlaze II or Dow Corning® HM-2500. One of the advantages of the use of hot melt silicone adhesive over other materials is that the recovery time of silicone is insignificant. The method comprises the steps of: injecting the hot adhesive in a liquid state with a melt gun directly on the desired areas of the garment; bringing the two pieces together; cooling down the region until the adhesive reaches a sticky/tacky state or fully cures holding thus the fabrics together allowing further manufacturing. When the silicon cures, the elastomer will be strong and stretchable. One of the advantage of the present method is that only the adhesive is heated and not the garment. Cool air can be blown on the adhesive to speed up the solidification process. Therefore the risk of burning the garment is eliminated, and the time delay for the heat to be transferred through garment to the elastomer is avoided and the manufacturing time reduced.

The elastomeric material of the present invention has the following properties: flexible and stretchable, strong enough to many washing and drying cycles, unaffected by water and washing chemicals and safe to wear. Optionally, the material may be translucent to match garments of any color. The material may include therefore selected a silicone (particularly a reactive hot melt silicone, for example one of the following commercially available products: Dow Corning® InstantGlaze, Dow Corning® InstantGlaze II or Dow Corning® HM-2500), a RTV (Room Temperature Vulcanization) polymer either alone or with addition of diluents (for example DOW CORNING® 3-3442 Flowable textile elastomer), a UV (Ultra-Violet) curable adhesives (for example Loctite Nuva-Sil 5091), or a combination of the above. The material may also include polyurethane or another elastomer, having the required properties detailed above.

This is yet another object of the present invention to provide an apparatus and a method for industrial production of garments having an integrated cost effective elastic bond. Particularly the cutting, the hemming, and the bonding are all accomplished simultaneously in parallel in one continuous step on an assembly line.

One embodiment of the method includes the steps of cutting the textile fabric by scissors operated mechanically as the apparatus advances on the fabric; folding the edge to create a parallel hem; injecting an elastomeric material onto the fabric at an appropriate rate (appropriate for the fabric type, the conveyer speed, the required strength flexibility and dimensions of the bond, the specific predetermined bonding areas and the design of the garment); and controlling gatherings in the garment.

In order that the final garment made out of a non-elastic material and an elastomer be elastic, it is necessary to create gatherings in the non-elastic material. The present invention supplies a method to create gatherings on line in a continuous process. An embodiment of the production of gatherings according to the present invention is illustrated in FIG. 2. Two tractors 250*a-b* advance the fabric. The second tractor 250*b* is moving the fabric at a speed that is lower than the first tractor 250*a*. This rate differences causes the excess fabric between the first tractor 250*a* and the second tractor 250*b* second to gather. In the embodiment of FIG. 2 tractors 250*a-b* are gears with equal lengths of motion (diameters) that are rotated at different speeds. In an alternative embodiment the two tractors may include a synchronized motion source (e.g. rotate at the same speed), but have different lengths of motion (e.g. diameters). The disadvantage of such a system based on the length of motion of the tractor is that in order to change the degree of gathering, it is necessary to change the tractors. can only create gatherings of a single degree depending on the ratio of the travel lengths of the teeth.

Figure 1B:
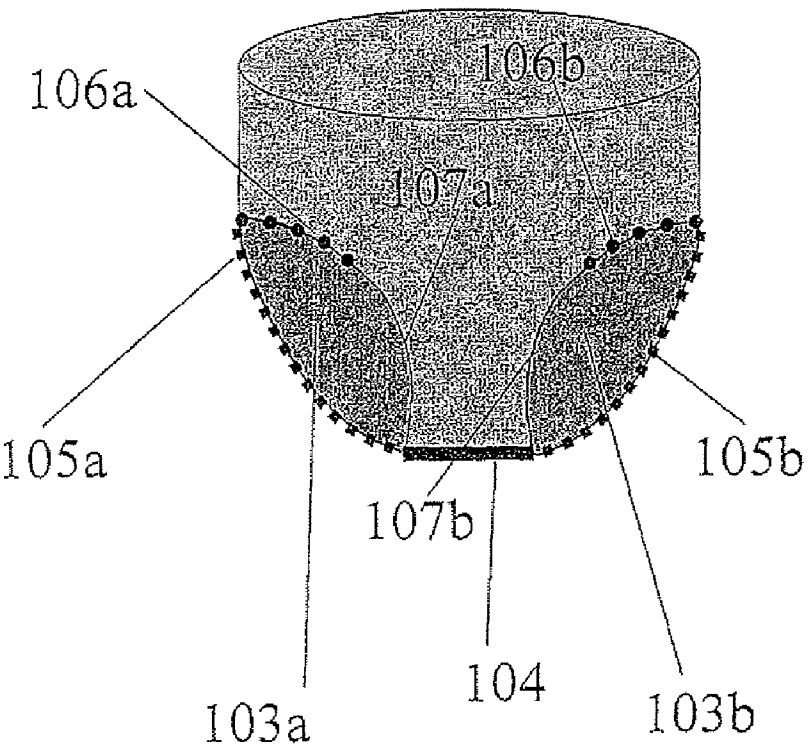
FIG. 1*b*, illustrates a second step in the production of a typical panty leg hole.
Figure 1A:
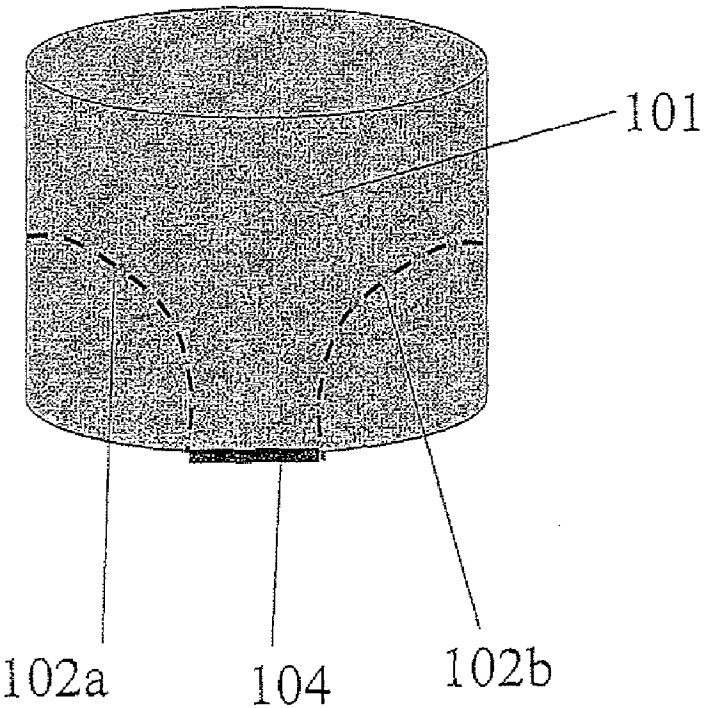
FIG. 1*a*, illustrates a first step in the production of a typical panty leg hole.

FIG. 2 illustrates one embodiment of the present invention having a first tractor 250*a* and a second tractor 250*b* for moving fabric 216. Tractors 250*a-b* both have the same travel length. Each of tractor 250*a-b* is driven by an adjustable speed computer controlled motor 252*a-b*. Driving second tractor 250*b* at a lower speed than the speed of first tractor 250*a* causes the fabric 216 to gather between tractors 250*a-b*. The degree of gathering is controlled by a computer 254, which adjusts the rate of second tractor 250*b* to produce stretching and reduce gathering or reduces the rate of second tractor 250*b* to increase gathering. Thus, the apparatus of FIG. 2 can produce a hem with differing degrees of gathering in different locations as illustrated in panty leg holes 103*a-b* in FIG. 1. The method further comprises the steps of curing in accordance with the type of adhesive. All these operations are coordinated by computer 254.

According to another embodiment of the present invention, a method for controlling the bonding of garments with elastomers by means of computer is provided. The method includes the steps of accepting operator's input; reporting the operator's input to factory's management and providing feedback and status data. The method further includes the steps of continuously determining the positioning of the apparatus on the garment; starting and/or stopping the adhesive injection; determining the amount of the adhesive to be injected; determining the amount of gathering; translating these amounts into real time signal to motors, relays, and other parts of the apparatus hardware; notifying the operator about the amount of adhesive remaining in the container and alerting about any emergency situations.

In alternative embodiments, the method further includes the steps of maintaining the melt adhesive in a steady temperature, activating and/or deactivating the UV light, and/or the cooling air jet. The method further includes the steps of checking the authenticity and expiry date of the adhesive. The method further includes the steps of reporting a plurality of data selected from the group consisting of types and numbers of garments produced, rejected pieces, working times and execution times.

Figure 5:
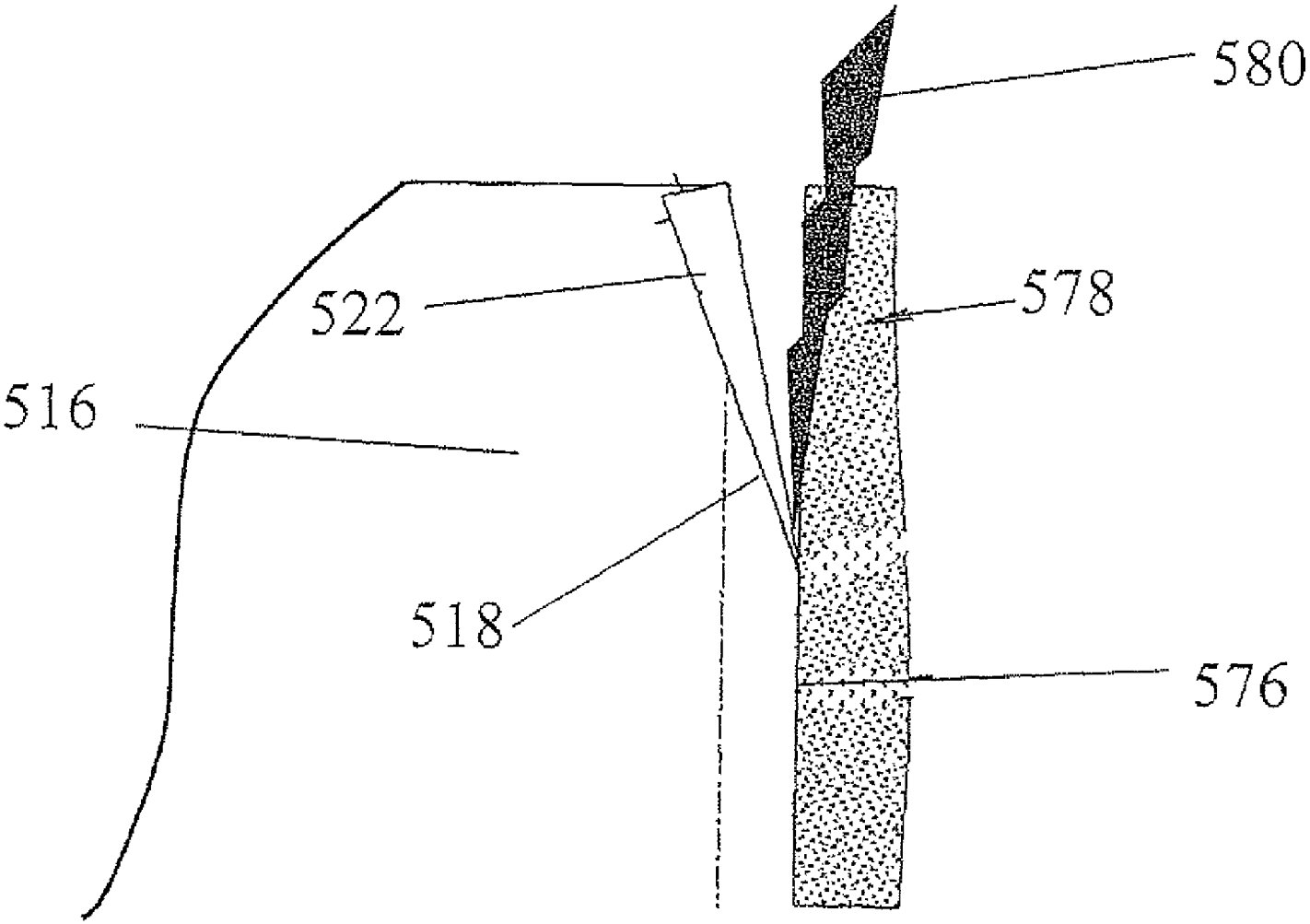
FIG. 5, illustrates in line continuous folding of a freshly cut edge.

Attention is now directed at FIG. 5, which illustrates in line continuous folding of a freshly cut edge 518. A cutting apparatus 580 cuts along a line 576 on a fabric 516 and edge 518 is pulled up leaving behind waste material 578. The resulting hem 522 tends to be diagonal to a cutting line 576. To make a parallel hem, edge 518 has to be straightened.

Figure 6:
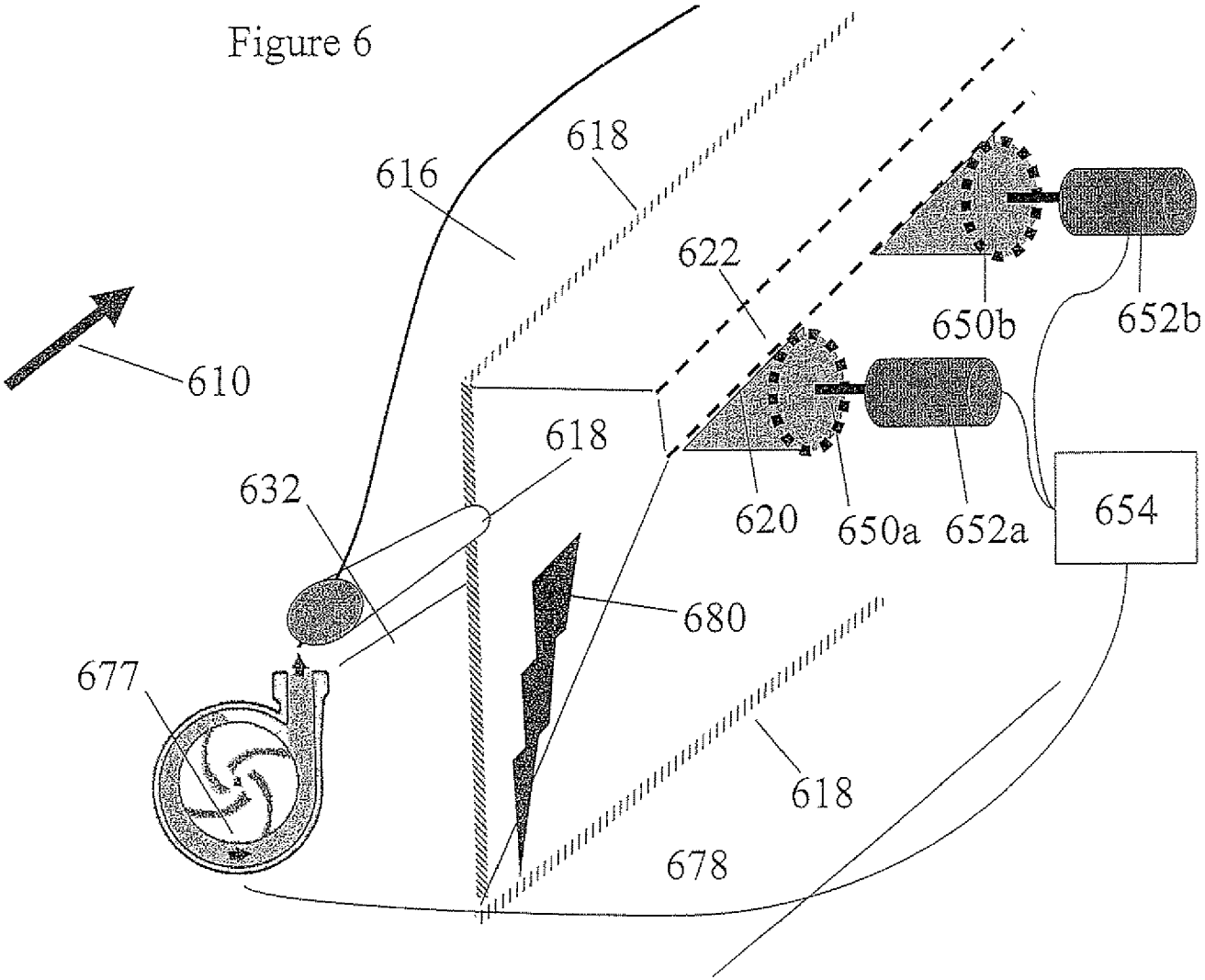
FIG. 6, illustrates a system for bonding a textile article in a single continuous process.

Attention is now directed at FIG. 6, which illustrates an embodiment of a system for bonding a textile article in a single continuous process. A fabric 616 moves in a direction 610, a cutting apparatus 680 cuts the edge of fabric 616. Cutting apparatus 680 is operated mechanically as fabric 616 advances. The system also includes motors 652*a-b*, operative to turn tractors 650*a-b*. Edge 618 is folded along line 620 and first tractor 650*a* pulls the folded freshly cut edge 618 forward. A computer 654 commands second motor 652*a* to cause tractor 650*b* to pull at the same speed as tractor 650*a* (with minor adjustments when necessary) to straighten edge 618 and to make a parallel hem 622. Waste material 678 is disposed of.

According to the embodiment of FIG. 6 the system includes a pump 677 controlled by computer 654. Pump 677 impels liquid adhesive into injecting head 632 operative to inject the elastomeric material onto fabric 616. Computer 654 adjusts the action of pump 677 and hence the rate of flow of adhesive according to the need for different garments and different locations.

Alternatively, the liquid elastomer may be applied to two sides of a ribbon and the ribbon placed in the garment in place of applying the bead of elastomer directly onto the garment.

According to still further features in the described preferred embodiments, the apparatus includes two injecting heads, the first is operative to inject a UV curable adhesive and the second is operative to inject a low cost RTV on a predetermined bonding area onto the fabric; two sets of computer controlled pumps, and at least one UV light source operative to illuminate the bonding to causes the UV adhesive to cure.

According to another embodiment of the present invention the apparatus further includes a plurality of teeth having the same travel length operative to create gatherings; and a plurality of computer controlled motors, rotating at different speeds, adapted to control the gathering formation.

While the invention has been described with respect to a limited number of embodiments, it will be appreciated by persons skilled in the art that the present invention is not limited by what has been particularly shown and described herein. Rather the scope of the present invention includes both combinations and sub-combinations of the various features described herein, as well as variations and modifications which would occur to persons skilled in the art upon reading the specification and which are not in the prior art.

What is claimed is:

1. A system for integrating an adhesive into a garment comprising:

a) a liquid adhesive;

b) a first injecting head for depositing said liquid adhesive onto a location on the garment;

c) a first tractor to feed the garment past said first injection head at a first rate, and d) a second tractor said second tractor configured for advancing the garment at a second rate, wherein said second tractor is configured for forming a gather in the garment and said second rate of advancing the garment is slower than said first rate of feeding the garment past said first injection head.

2. The system of claim 1 wherein said liquid adhesive includes at least one adhesive selected from the group containing a heat cured elastomer a silicon based elastomer, a hot melt elastomer, a UV cured elastomer, a catalyst cured elastomer, and a RTV elastomer.

3. The system of claim 1, further comprising:

e) a computer to control a rate of depositing said liquid adhesive.

4. The system of claim 1, further comprising:

e) a mixer for mixing a fluid into said liquid adhesive.

5. The system of claim 1, further comprising:

e) a second injecting head for depositing a fluid onto the garment.

6. The system of claim 5, wherein said fluid is applied as a narrower bead than said liquid adhesive.

7. The system of claim 5, where said fluid includes at least one fluid selected from the group consisting of a catalyst for said liquid adhesive, UV cured elastomer, a combination of an elastomer and a catalyst, another adhesive having more rapid curing than said liquid adhesive and an RTV elastomer.

8. The system of claim 1, further comprising:

e) a cutting apparatus for cutting the garment and wherein said liquid adhesive bonds a hem of an edge resulting from said cutting of the garment.

9. The system of claim 8, where said cutting apparatus and said first injecting head are located in-line such that said cutting of the garment and said depositing of said liquid adhesive onto a location on the garment occur simultaneously.

10. The system of claim 1, further comprising:

e) a third tractor for straightening the garment, said third tractor configured for advancing the garment at a third rate.

11. The system of claim 10 wherein said third rate of advancing the garment is equal to said first rate of feeding the garment past said first injection head.

12. The system of claim 11 further comprising:

c) a cutting device for cutting the garment and wherein said parallel seam is a hem along an edge of a cut made by said cutting device.

13. The system of claim 12, wherein said cutting device, said first tractor and said second third tractor all act simultaneously on a single seam.

14. The system of claim 1 wherein said second rate of advancing the garment is adjustable independently of said first rate of feeding the garment past said first injection head.

15. The system of claim 14, further comprising:

e) a computer for controlling said second rate of advancing the garment.

16. The system of claim 1, wherein said liquid adhesive holds within 3 seconds.

17. The system of claim 1, wherein said liquid adhesive fully cures within 18 seconds.

18. The system of claim 1 wherein said liquid adhesive is configured to cure to form an elastic strip.

19. The system of claim 18, wherein said elastic strip has a thickness of 0.2-0.4 mm.

* * * * *